United States Patent [19]

Thomas

[11] 4,407,378

[45] Oct. 4, 1983

[54] NOZZLE RETENTION METHOD FOR ROCK BITS

[75] Inventor: Robert D. Thomas, Tonkawa, Okla.

[73] Assignee: Smith International, Inc.

[21] Appl. No.: 242,811

[22] Filed: Mar. 11, 1981

[51] Int. Cl.[3] ..... E21B 10/18

[52] U.S. Cl. ..... 175/340; 239/DIG. 19; 175/422

[58] Field of Search ..... 175/340, 393, 422; 239/289, 390, 591, 600, 602, DIG. 19; 285/104, 105, 374, 340

[56] References Cited

U.S. PATENT DOCUMENTS

| | | | |
|---|---|---|---|
| 3,111,179 | 11/1963 | Albers et al. | 175/393 |
| 3,189,107 | 6/1965 | Galle | 175/393 |
| 3,995,897 | 12/1976 | Paskert | 285/340 |
| 4,083,586 | 4/1978 | Helm | 285/105 |
| 4,193,463 | 3/1980 | Evans | 175/340 |
| 4,194,750 | 3/1980 | Sovish et al. | 285/110 |
| 4,241,878 | 12/1980 | Underwood | 239/591 |
| 4,268,041 | 5/1981 | Sovish et al. | 285/110 |

*Primary Examiner*—William F. Pate, III
*Assistant Examiner*—William P. Neuder
*Attorney, Agent, or Firm*—Robert G. Upton

[57] ABSTRACT

A method to retain a nozzle in a rock bit is disclosed for use particularly with air-type roller cone rock bits. A plastic nozzle body is formed with a multiplicity of radially disposed fins equidistantly spaced on the periphery of the nozzle body. A nozzle retention hole is formed in the body of the rock bit with a diameter slightly less than the diameter of the fins on the plastic nozzle. As the plastic nozzle body is forced into the nozzle retention hole, the fins deflect slightly in a downstream direction and "bite" against the nozzle retention walls formed by the bit body.

3 Claims, 3 Drawing Figures

NOZZLE RETENTION METHOD FOR ROCK BITS

BACKGROUND OF THE INVENTION

1. Field of the Invention

This invention relates to fluid nozzles utilized in rock bits.

More particularly, this invention relates to the use of a plastic nozzle for mining bits that utilize air as the fluid to cool the bit during operation.

2. Description of the Prior Art

Replaceable nozzles for rock bits have been within the state of the art for many years. Where the media to cool and clean a rock bit during operation is in a highly erosive liquid form, such as drilling "mud", the nozzles are typically fabricated from tungsten carbide or the like. These replaceable nozzles are retained in a variety of ways which include the following: threading the nozzle within a rock bit body; pinning the nozzle within the body by utilizing one or more dowel pins; retention of the nozzle in a bit body by utilizing a nail or malleable pin that is driven into an annular groove formed between the nozzle body and the rock bit body; and the use of a variety of snap rings to retain the nozzles within the bit body.

Where air is the cooling and cleaning media, the nozzles are subject to less wear and tear during operation. Thus it has been determined that certain types of plastic nozzles will function with air as the cooling fluid.

U.S. Pat. No. 3,971,577 discloses a union device for flexible tubing. The device comprises a body having an inner bore communicating with an enlarged annular opening in a face of the body. A separate annular bushing is secured in the opening with a press fit by means of an external barb on the bushing which opposes removal of the bushing. The bushing has an oppositely directed internal annular barb which engages in the outer surface of the end of a press fitted flexible tube to tightly secure the tube without constricting its inner passageway which communicates with the bore.

The foregoing invention discloses a single circumferential protrusion which is designed to engage the wall of a plastic opening. The bore opening is slightly less in diameter than the barb portion of the circumferential barb on the inner bushing. Since the inner bushing forming the circumferential barb is fabricated from a metal material, the barb will damage the bore opening in the plastic body when the inner bushing is subsequently removed. The inner bushing cannot be subsequently reinserted because the bore opening is now damaged by the annular barb portion on the bushing.

The present invention overcomes the foregoing problem in that the nozzle is fabricated from plastic and a plurality of equidistantly spaced fins radially extend from the nozzle body. Each fin is extended far enough so that they are relatively flexible. Upon insertion of the finned plastic nozzle into its nozzle retention hole, the multiplicity of fins are deflected and "bite" into the walls of the nozzle retention hole. The bore opening of the nozzle body formed in the rock bit is, of course, slightly less in diameter than the diameter of each of the flexible fins of the nozzle body.

SUMMARY OF THE INVENTION

It is an object of this invention to provide a plastic fluid nozzle for a rock bit.

More particularly, it is an object of this invention to provide a plastic nozzle for a mining type rock bit that utilizes air as a cooling fluid. The nozzle is retained within a nozzle body opening in a rock bit by deflection of a series of equidistantly spaced radially extending fins integral with the nozzle body. The outer circumferential edge of each fin bites into the walls of the nozzle retention hole thus preventing egress of the nozzle from the bit during operation.

This invention discloses a fluid nozzle retention device for a rock bit consisting of a rock bit body having a first pin end and a second cutter end. The bit body forms a fluid chamber in the pin end of the bit body. A circular nozzle retention cavity is formed in the bit body.

A circular nozzle body with a fluid orifice formed therein substantially axially through the body also communicates with the chamber. The nozzle body further forms a plurality of substantially equidistantly spaced, substantially radially extending fins integral with the body of each of the fins being relatively flexible. A circumference of each fin is slightly larger in diameter than the diameter of the cavity opening formed in the body. Insertion of the nozzle body into the cavity deflects each of the flexible plurality of fins in an axial direction whereby an edge of each fin grips the wall of the cavity retaining the nozzle in the cavity.

To remove the nozzle from the body the fins must deflect through an orientation that moves the fins to a position normal to the axis of the nozzle (largest fin diameter) to a deflected position in an upstream position which requires a great deal of force to accomplish.

An advantage over the prior art is the ability to remove the flexible nozzle from its retention cavity without damage to either the rock bit or the finned nozzle body.

Yet another advantage over the prior art is the fabrication of the nozzle from plastic material, the multiple integral flexible plastic fins having sufficient strength to retain the nozzle in its respective nozzle retention cavity without additional nozzle retention devices.

Still another advantage over the prior art is the multiple sealing function provided by each of the plurality of fins "biting" into the wall of the nozzle retention cavity, thus minimizing a fluid leak path external of the axially directed inner fluid passage.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
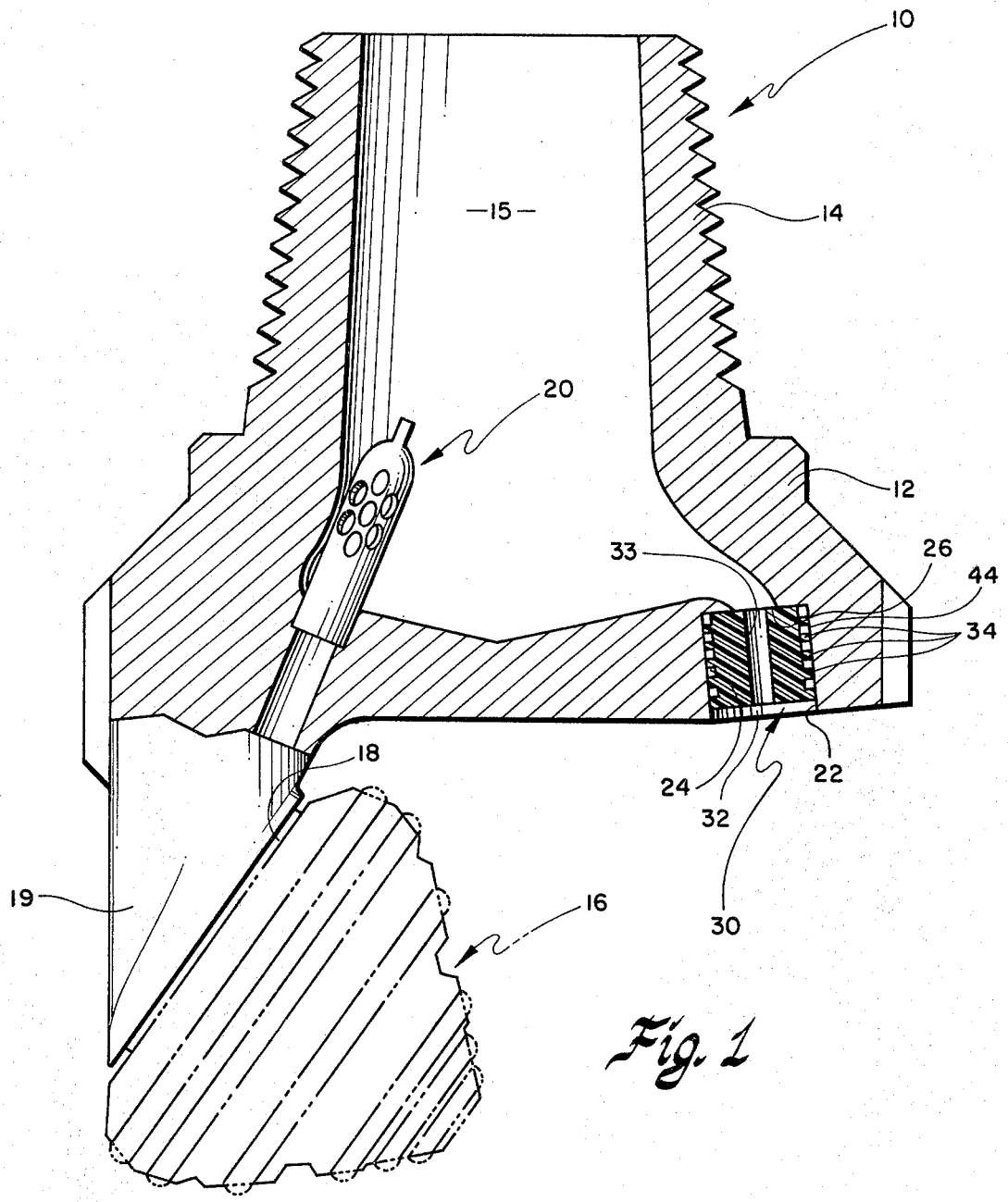
FIG. 1 is a partially cutaway, partially in phantom line, cross section of a typical mining bit.

With reference now to FIG. 1, a mining type air cooled multi-cone rock bit, generally designated as 10, consists of rock bit body 12 which defines a pin end 14 and leg portions 19. Affixed to the leg or shirttail 19 is a cone, generally designated as 16. The cone rotates on a journal 18 cantilevered from leg 19. A water separator filtering device 20 directs air through the bearing surfaces defined between the journal and the cone.

One or more nozzle retention holes 22 are formed in the bit body 12. The walls 24 of the nozzle retention holes are substantially parallel.

The bottom of the cavity 22, indicated as 26, communicates with the interior chamber 15 in pin end 14 of bit body 12 of rock bit 10.

A nozzle, preferably fabricated from plastic and generally designated as 30, consists of a nozzle body 32. The nozzle body further defines a central orifice 33 that is substantially axially positioned through the nozzle body. The nozzle 32 forms a plurality of radially disposed equidistantly spaced fins 34 integral with the nozzle body 32. Where the overall diameter of the nozzle is for example one and one-quarter of an inch, each fin would protrude from the main nozzle body 32 between forty and sixty thousandths of an inch. The preferred extension of each fin is fifty thousandths of an inch.

Figure 2:
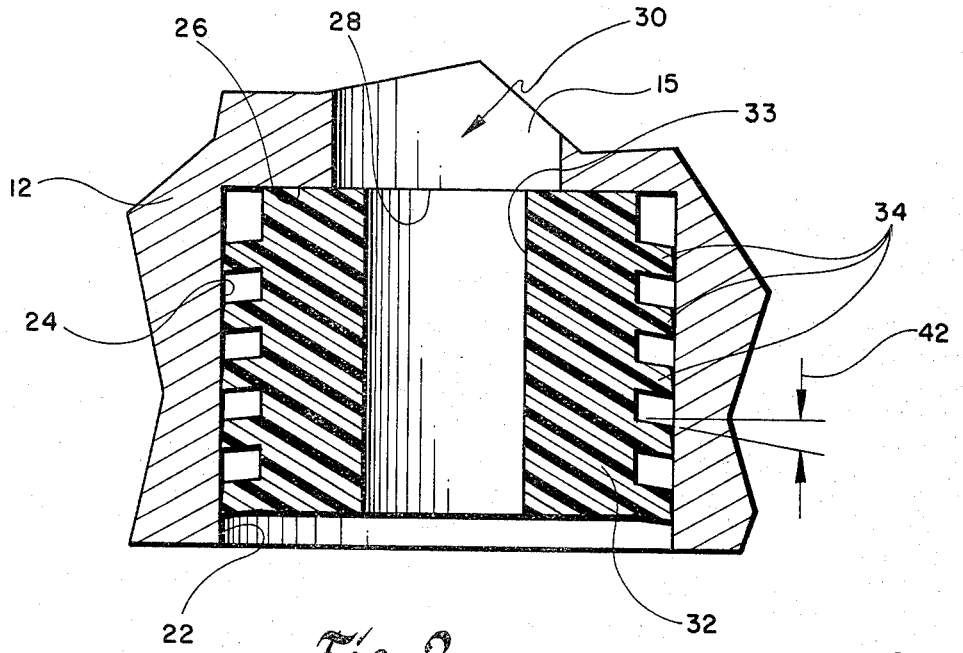
FIG. 2 is a partial cross section of a plastic nozzle retained in a nozzle retention cavity formed in a rock bit body.

With reference to FIG. 2, the five radially disposed fins 34 are shown deflected slightly in a downstream direction upon insertion of the nozzle body 32 into the cavity 22. The bottom 28 of the nozzle body 32 seats against surface 26 of cavity 22. The amount of downstream deflection of each fin is indicated as 42 in FIG. 2.

Figure 3:
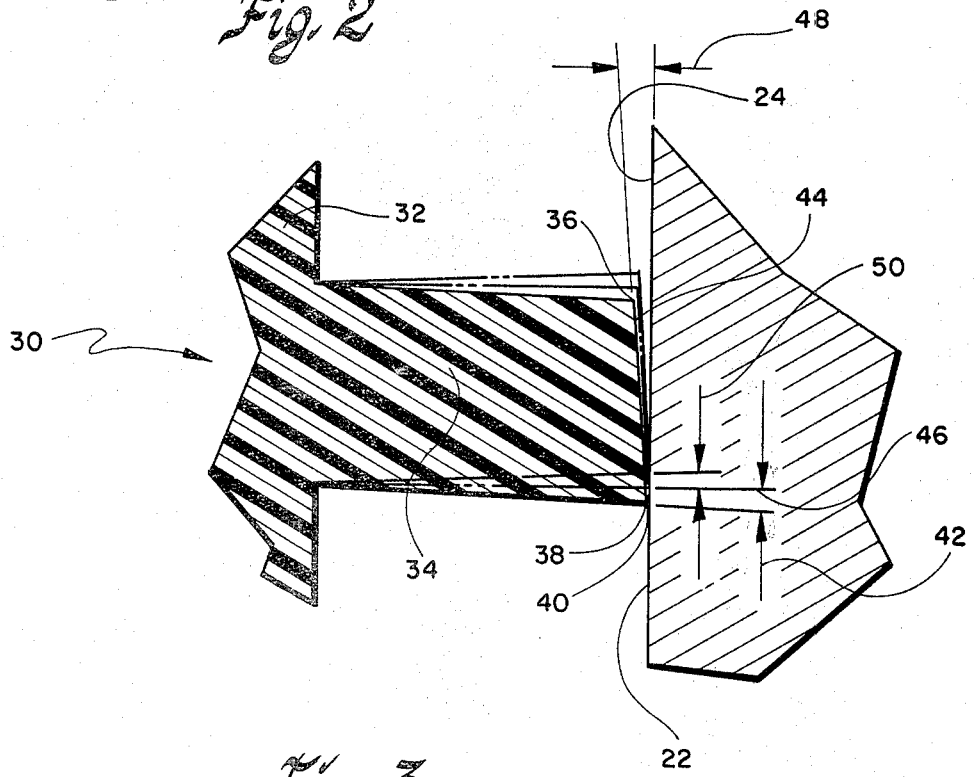
FIG. 3 is a partial cross section of one of the radially extending fins integral with the nozzle body as it is deflected against the nozzle retention wall formed by the rock bit body.

Referring now to FIG. 3, each fin defines an upstream diameter 36 which is less in diameter than the downstream diameter 38, thus difining an angle 48 that is between three and ten degrees from the axial centerline of the nozzle body 32. The angle 48 is preferably five degrees. It is evident then that peripheral edge 40 will bite into wall 24 of bit body 12 when the nozzle body is forced into engagement with cavity 22. The outside diameter of each of the fins, as measured to edge 40 of downstream diameter 38, is from ten to seventeen thousandths of an inch over the diameter of the retention cavity 22 where the cavity diameter is, for example, one and one-quarter of an inch. Thus, in order to insert the plastic nozzle within cavity 22, each of the fins 34 must deflect in a downstream direction to conform to the less diameter of the cavity 22. As shown in FIG. 3, each fin will deflect an amount indicated as 42 from a non-deflected position 46.

In order to remove the flexible plastic nozzle from cavity 22, each of the fins 34 is deflected past the neutral position 46 to the reversed deflected upstream fin position 50. Obviously, a great deal of force is required to invert each of the fins 34 to the upstream position to remove the nozzle from the cavity.

Since each fin 34 is forced into engagement with the nozzle retention wall 24 of hole 22, an effective seal is achieved at each fin position thereby providing multiple seals. Fluid thus is prevented from escaping past the fins, the flow of the fluid being directed through the central nozzle opening 33 in each of the nozzle bodies 32.

The plastic material utilized to fabricate the nozzles is preferrably a polyurethane material. Any other suitable flexible plastic materials may be incorporated to fabricate the nozzles while remaining within the scope of this invention.

It would be further obvious to fabricate the nozzle bodies from certain types of metal whereby the fins would be so configured to provide flexibility to assure solid engagement of each of the fins within a nozzle retention cavity.

While one nozzle is shown, it would be obvious to provide multiple nozzles in a rock bit.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A fluid nozzle retention device for a rock bit comprising:

a rock bit body having a first pin end and a second cutter end, said bit body forming a fluid chamber in said pin end of said bit body, a circular nozzle retention cavity formed in said bit body, said cavity having substantially parallel walls, said cavity being in fluid communication with said chamber, and a circular nozzle body, said body forming a fluid orifice substantially axially through said body communicating with said chamber, said body further forming one or more substantially radially extending fins integral with said body, each of said fins being relatively flexible, a circumference of each fin being slightly larger in diameter than the diameter of said cavity formed in said rock bit body, each fin extends beyond said nozzle body from forty to sixty thousandths of an inch where the diameter of the nozzle body is about one and one-quarter of an inch, insertion of said nozzle body into said cavity deflects each of said one or more flexible fins in an axial direction whereby an edge surface of each fin grips said wall of said nozzle retention cavity retaining said nozzle in said cavity.

2. A fluid nozzle retention device for a rock bit comprising:

a rock bit body having a first pin end and a second cutter end, said bit body forming a fluid chamber in said pin end of said bit body, a circular nozzle retention cavity formed in said bit body, said cavity having substantially parallel walls, said cavity being in fluid communication with said chamber, and a circular nozzle body, said body forming a fluid orifice substantially axially through said body communication with said chamber, said body further forming one or more substantially radially extending fins integral with said body, each of said fins being relatively flexible, a circumference of each fin being slightly larger in diameter than the diameter of said cavity formed in said rock bit body, each fin extends beyond said nozzle body fifty thousandths of an inch where the diameter of the nozzle body is about one and one-quarter of an inch, insertion of said nozzle body into said cavity deflects each of said one or more flexible fins in an axial direction whereby an edge surface of each fin grips said wall of said nozzle retention cavity retaining said nozzle in said cavity.

3. A fluid nozzle retention device for a rock bit comprising:

a rock bit body having a first pin end and a second cutter end, said bit body forming a fluid chamber in said pin end of said bit body, a circular nozzle retention cavity formed in said bit body, said cavity having substantially parallel walls, said cavity being in fluid communication with said chamber, and a circular nozzle body, said body forming a fluid orifice substantially axially through said body communicating with said chamber, said body further forming one or more substantially radially extending fins integral with said body, each of said fins being relatively flexible, a circumference of each fin being slightly larger in diameter than the diameter of said cavity formed in said rock bit body, said circumference of each fin is ten to seventeen percent larger in diameter than the diameter of said nozzle retention cavity formed in said bit body, insertion of said nozzle body into said cavity deflects each of said one or more flexible fins in an axial direction whereby an edge surface of each fin grips said wall of said nozzle retention cavity retaining said nozzle in said cavity.

* * * * *